US005898939A

United States Patent [19]

Schramm

[11] Patent Number: 5,898,939

[45] Date of Patent: May 4, 1999

[54] PROTECTIVE PAD FOR THE FOOT AND SHIN OF A PERSON WITH A TONGUE-LIKE EXTENSION, IN PARTICULAR OF AN ATHLETE

[75] Inventor: Günther Schramm, Dachau, Germany

[73] Assignee: Schramm Sport GmbH, KWON-Kampfsportausstattung, Vierkirchen, Germany

[21] Appl. No.: 08/980,905

[22] Filed: Dec. 1, 1997

[51] Int. Cl.[6] ..... A41D 13/00

[52] U.S. Cl. ..... 2/22; 2/455; 36/1.5; 602/27

[58] Field of Search ..... 2/22, 24, 16, 455, 2/62; 602/27, 65, 26, 62, 23; 36/1.5, 2 R, 71

[56] References Cited

U.S. PATENT DOCUMENTS

| | | | |
|---|---|---|---|
| 1,624,129 | 7/1927 | Barrett | 425/180 |
| 2,902,779 | 9/1959 | Cook | 36/2 |
| 3,416,156 | 12/1968 | Marvid | 2/22 |
| 3,475,835 | 11/1969 | Kovar | 36/1.5 |
| 3,908,645 | 9/1975 | Sandvig | 128/97 |
| 4,497,070 | 2/1985 | Cho | 2/22 |
| 4,633,529 | 1/1987 | Litz | 2/22 |
| 4,692,946 | 9/1987 | Jurga | 2/22 |
| 4,876,745 | 10/1989 | Richards | 2/24 |
| 5,507,720 | 4/1996 | Lampropoulos | 602/27 |
| 5,711,028 | 1/1998 | Bourque et al. | 2/22 |
| 5,732,411 | 3/1998 | Coleman et al. | 2/22 |
| 5,742,938 | 4/1998 | Winningham et al. | 2/22 |

FOREIGN PATENT DOCUMENTS

| | | |
|---|---|---|
| 1744809 | 3/1957 | Germany . |
| 8030463 | 3/1981 | Germany . |
| 8403767 | 7/1984 | Germany . |

*Primary Examiner*—John J. Calvert
*Assistant Examiner*—Tejash D. Patel
*Attorney, Agent, or Firm*—Evenson, McKeown, Edwards & Lenahan, PLLC

[57] ABSTRACT

The subject matter of the invention is a protective device for the foot and shin of a person, particularly of an athlete, with a foot section (3) and a shin guard (2) in which to ensure the protection of the zone between the foot and the shin without any impediment to the person, the foot section (3) and/or the shin guard (2) possess(es) a tongue-like extension (31, 21).

27 Claims, 5 Drawing Sheets

Figure 1:
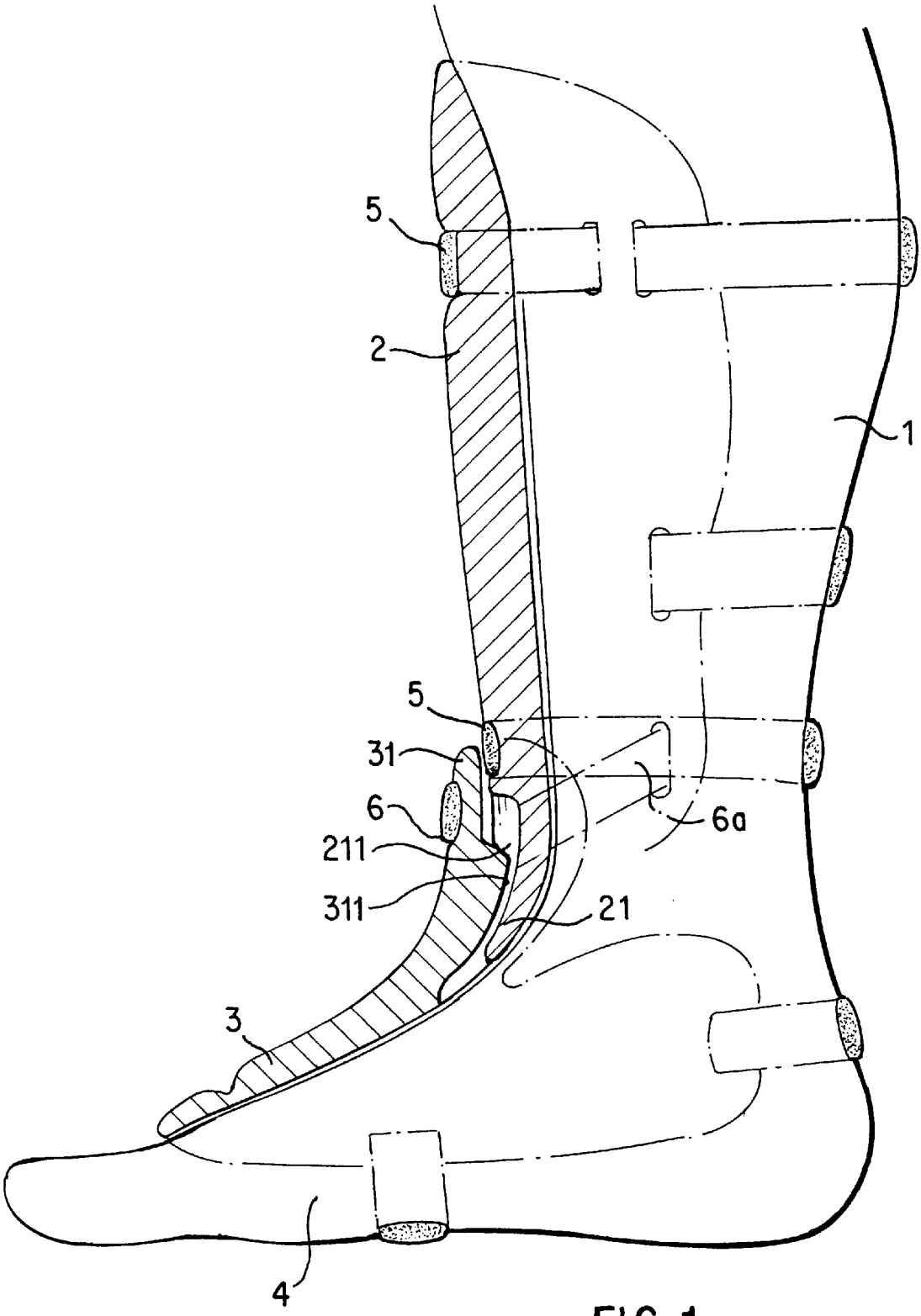

PROTECTIVE PAD FOR THE FOOT AND SHIN OF A PERSON WITH A TONGUE-LIKE EXTENSION, IN PARTICULAR OF AN ATHLETE

DESCRIPTION

The invention relates to a protective pad for the foot and shin of a person, in particular of an athlete, with a foot part and a shin guard.

In various types of sports, an unimpeded movement of the ankle joint is an elementary, basic requirement for the optimum exercise of the sport. At the same time, in many of these types of sports, there is a special risk of injury in the ankle joint area due to actions of an opponent or team mate or from bats used by the players in the exercise of their sport. This risk of injury requires a special pad, but such a pad in the ankle joint area is a hindrance to mobility in all solutions practised hitherto.

In many types of competitive sports between two opponents, in soccer and in hockey, the area at the front side of the ankle joint is at risk, particularly in direct challenges. For this reason, in competitive sports between two opponents, at least the lower shin is padded with shin guards, the metatarsus and instep by instep and foot guards. Soccer, cricket and hockey players use shin guards and shoes with padded tongues to protect the instep area.

However, between the instep and the shin, the particularly endangered area of the lower tibial plateau and the foot tarsal bones practically always remain unprotected. Continuous pads which cover the endangered areas in every situation from the metatarsus up to the upper shin are, however, at least unusual For such a continuous pad would be compressed when the foot is raised due to the shortening of the inside tendon in the ankle joint area and, in contrast, tautened when the foot is extended. Both processes at least involve an effort which impairs the movement of the foot and are therefore not accepted in competitive sports where one always has to give 100%.

Generally, therefore, the protective pad for the foot area and the pad for the shin are two separate parts which are maximally positioned at such a close distance to each other that with the foot maximally raised they just contact each other above the tarsus. However, this means that with the foot extended, a distance opens up in the order of around 5 cm between the foot pad and the shin pad. As a result, a very sensitive and endangered body part is unprotected just in direct challenge situations, for it is just then that the foot is often extended fully.

Protective pads for the foot and shin of the type described above are known from U.S. Pat. No. 1,624,129 and U.S. Pat. No. 4,692,946. These known protective pads possess a foot part and a shin guard which are connected via a flexible portion.

Furthermore, the German utility model 84 03 767 discloses a knee/shin/foot guard which possesses a shin protection element at the upper end of which a knee protection element and at the bottom end of which a foot protection element is located.

Furthermore, a leg guard is known from the German utility model 17 44 809 made from light sheet metal in which the light sheet metal is pulled down over and beyond the ankle joint.

Moreover, U.S. Pat. No. 4,876,745 discloses a knee pad which is connected to a section directed downwards to protect the shin. This section also covers part of the foot, but not by means of a tongue-like extension, but in an integral configuration.

In accordance with U.S. Pat. No. 4,633,529 a protective pad consists of a plurality of sections which are all connected to one another by means of elastic intermediate portions.

Furthermore, a leg guard for persons engaged in competitive sports, in particular karate fighters, is known from the German utility model 80 30 463 which possesses a flexible pad cushion with a step section covering the top of the foot, which pad cushion can be placed around the shin and fixed in place by means of straps, for example Velcro straps. To allow the leg guards to be adapted to different types of competitive sports and the different rules these involve and to obtain a better protection, the pad cushion should possess at least on one side an extended zone as an ankle protection. The pad step section covering the top of the foot is detachably connected to the pad cushion.

Finally, a protective pad is known from U.S. Pat. No. 1,624,129 which in those areas of interest here essentially corresponds to that in accordance with U.S. Pat. No. 4,633,529. Knee guards, shin guards and foot guards are each connected to one another by means of elastic intermediate portions due to which important parts of the body remain without protection.

It is the object of the invention to propose a protective pad of the type first described with which the protection of that area between the foot and the shin can be ensured without any impediment to the person or athlete.

This object is solved in accordance with the invention by the foot section and/or the shin guard possessing a tongue-like extension.

In accordance with the principle of the invention, the protective pads for the foot and shin overlap on the front side of the foot or shin in any contest or game situation. The overlap is only a minimum amount when the foot is extended, that is when the tendon above the ankle joint is at maximum extension. The overlap is maximal when the foot is raised up. For this purpose, either a tongue-like extension is located in the direction of the shin at the foot section or at the protective pad on the foot side or a tongue-like extension is located at the shin guard towards the foot. However, it is also possible for both pads, that is the foot section and the shin guard, to possess one tongue-like extension each—generally shorter in this case—which extensions overlap. In this way, protection of the area between the foot and shin is ensured in every contest or game situation. At the same time, it is ensured that the athlete is not impeded by the protective pad in accordance with the invention.

The "tongue-like extensions" characteristic for the invention are neither anticipated nor made obvious by the German utility model 84 03 767.

The configuration in accordance with the German utility model 17 44 809 cannot be considered a "tongue-like extension" within the meaning of the subject matter of the invention either.

The integral design in one piece without any tongue-like extension in accordance with U.S. Pat. No. 4,876,745 has the disadvantage described in the first paragraph on page 6 that the mobility of the foot is hindered.

Tongue-like extensions within the meaning of the subject matter of the invention are not contained in U.S. Pat. No. 4,633,529 either, and the disadvantage described in the second paragraph on page 2 arises where an unprotected area exists between the lower end of the shin guard and the upper end of the foot guard.

As the German utility model 80 30 463 has no drawing attached to it, the exact appearance of the leg guard described there cannot be imagined. In any case, the characteristic feature of the subject matter of the invention, according to which the foot section and/or the shin guard possess(es) a tongue-like extension, cannot be seen from claim 1 or the other content of this utility model.

Tongue-like extensions within the meaning of the invention are neither disclosed nor made obvious by U.S. Pat. No. 1,624,129. Advantageous embodiments are described in the dependent claims.

It is possible to provide a first tongue-like extension on the shin guard and a second tongue-like extension on the foot section.

A further advantageous embodiment is characterised in that a first tongue-like extension is provided on the foot section and a second tongue-like extension on the shin guard. In accordance with this proposal, primarily a (first) tongue-like extension is fixed on the foot section of the protective pad. The (second) tongue-like extension on the shin guard is preferably shorter. By means of the advantageous embodiment described, it is made possible to use the shin guard either independently of the compatible foot protection pad or with any conventional protection suitable for the relevant type of sport. The function of the system in accordance with the invention is described accordingly below. In general, however, the system is also applicable to the reverse situation with a (somewhat longer first) tongue-like extension on the shin guard (and a shorter second tongue-like extension on the foot section).

It is advantageous to provide the first tongue-like extension on a shoe, particularly a sports boot such as a soccer boot. In this case, the conventional tongue already fitted on the sports boot can be formed in such a way that it forms the first tongue-like extension.

Preferably, the foot section is formed as a foot guard or a foot and instep guard. It is furthermore advantageous to design the first tongue-like extension to be longer than the second tongue-like extension.

In any case, it is advantageous if the tongue-like extension or the tongue-like extensions are designed to be easily flexible. For the tongue-like extension must adapt to the very tight radius when the foot is raised and to the almost flat transition from the foot to the shin when the foot is extended. Preferably, the tongue-like extension is formed as a soft foam protective pad. Such a soft foam protective pad meets the requirements described.

There are basically two possibilities for the overlap:

(1) The tongue or the tongue-like extension of the foot section slides underneath the shin guard. In this case, it is advantageous if the shin guard possesses a tunnel-like concavity which matches the cross-section of the tongue and inside of which the tongue-like extension can slide lengthways. The guidance of the tongue or the tongue-like extension is ensured in a perfect manner as it is guided on all sides between the body surface and the tunnel walls.

(2) The tongue or the tongue-like extension of the foot section slides over the shin guard. It appears advantageous, also in this embodiment, to provide a guidance device. Such a guidance device may, for example, comprise a rail-like recess in the longitudinal direction of the shin guard and a matching sled-like fixture on the inside of the tongue-like extension, each in the overlap zone. In this embodiment, the tongue-like extension is naturally not guided on all sides, but only on three sides. It is thus not prevented from being bent away from the surface of the shin guard into air. In accordance with the invention, however, this bending away, which would lead to unacceptable functional impairments, should be definitely prevented. If the tongue-like extension should always contact the surface of the leg or the shin guard, it must still be pressed against the leg and shin guard with a not negligible pressure when the leg is in the furthest extended position so that it does not flap uncontrollably during the fast leg movement in the practising of the sport. To guarantee this, in accordance with an advantageous embodiment of the invention, it is proposed to design the inherent arching of the tongue-like extension in such a way that it is lower than the arching of the foot top in its furthest extended position.

However, as a result, the pressure in the most bent position, that is when the foot is raised, is very high due to the high bending stress in the tongue or the tongue-like extension. This produces relatively high friction between the tongue-like extension and the shin guard. Due to this high friction, jams may occur which may well prevent a free sliding when the foot is raised. Furthermore, it must be assumed that the tongue or the tongue-like extension will gradually be subject to fatigue due to the repeated bending stress in use with the consequence that after longer use it will then after all tend to hang away from the leg. If it then receives a kick from above in a challenge action, so that it is compressed or bent away, the arrangement will quickly become unusable. To prevent this, a further advantageous embodiment is characterised in that the tongue or the tongue-like extension and the shin guard are connected by an elastic strap. This system is designed in such a way that the tongue-like extension is always pulled to the shin guard by an elastic strap. The tongue-like extension is pulled to the shin guard relatively strongly in the extended foot position. In the bent foot position (that is with the tip of the foot raised up), the tongue-like extension is pulled to the shin guard relatively weakly by the elastic strap. The inherent arching of the tongue-like extension is set tightly and based on the minimum possible radius of the foot/leg transition. The tongue-like extension is thus not pressed on the shin guard at all by its own tension. There is no danger that the tongue will stand away from the lea after a certain time due to fatigue.

Advantageously, the protective pad is made from a plastic, preferably an ethylene/vinyl acetate copolymer.

Figure 4:
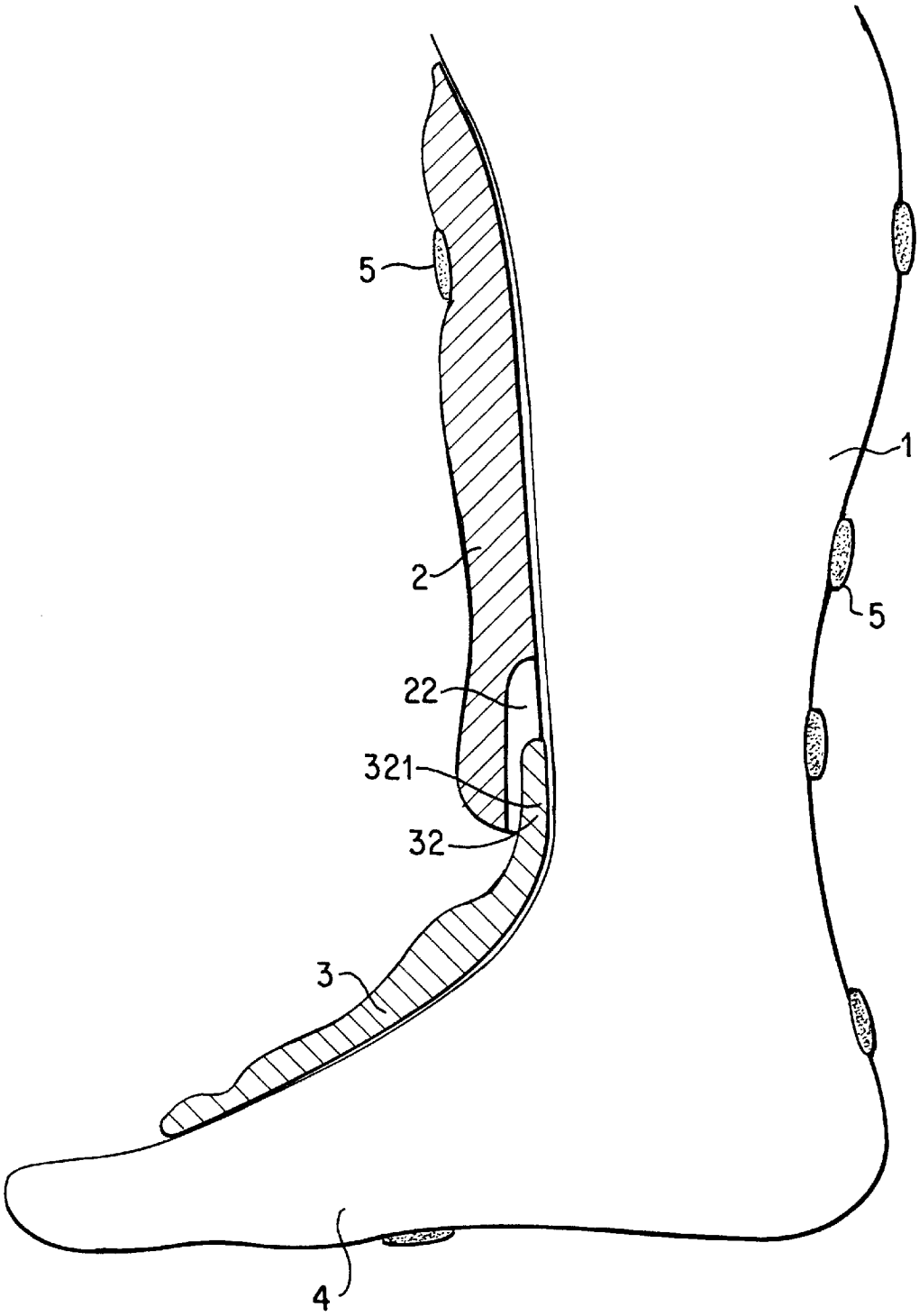
Figure 5:
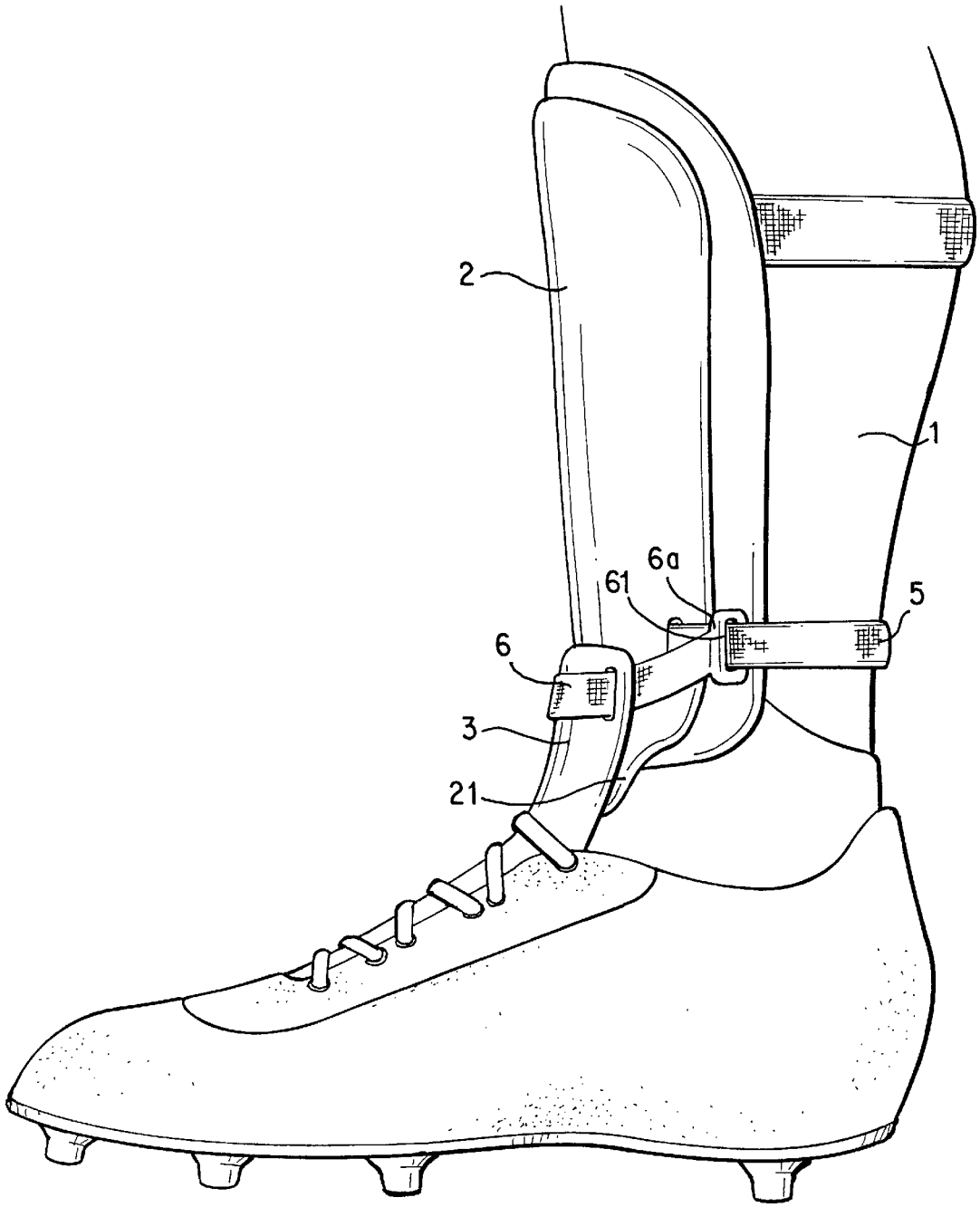

Embodiments of the invention are described below in detail by means of the attached drawing. In the drawing FIG. 1 shows a protective pad for foot and shin in a lateral cross-section, FIG. 2 shows the pad from FIG. 1 with an extended foot, FIG. 3 shows the pad from FIGS. 1 and 2 with a raised foot, FIG. 4 shows a modified embodiment of a protective pad for foot and shin, and FIG. 5 shows a further modification in which the tongue-like extension is connected to the tongue of a soccer boot.

Figure 2:
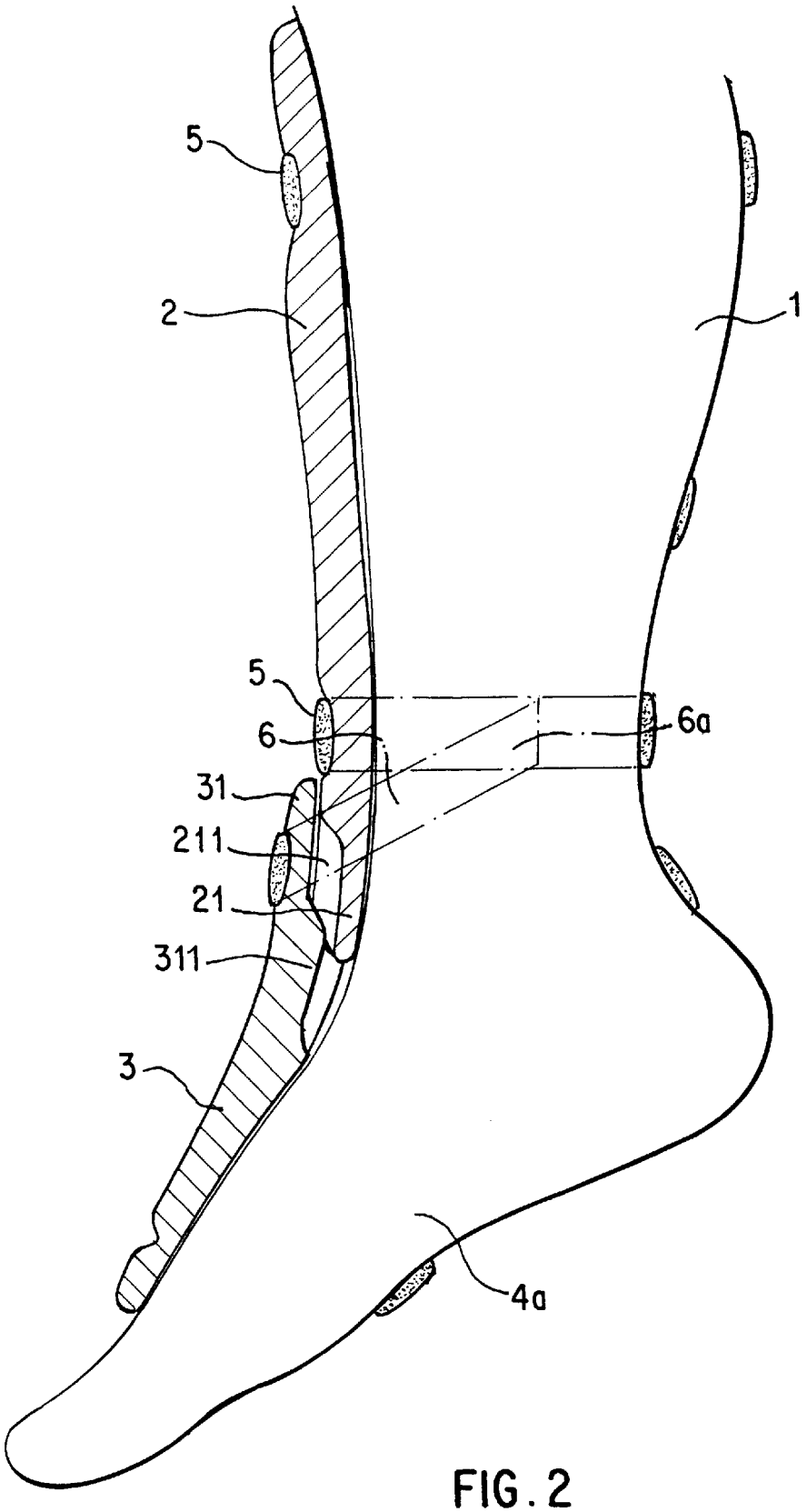
Figure 3:
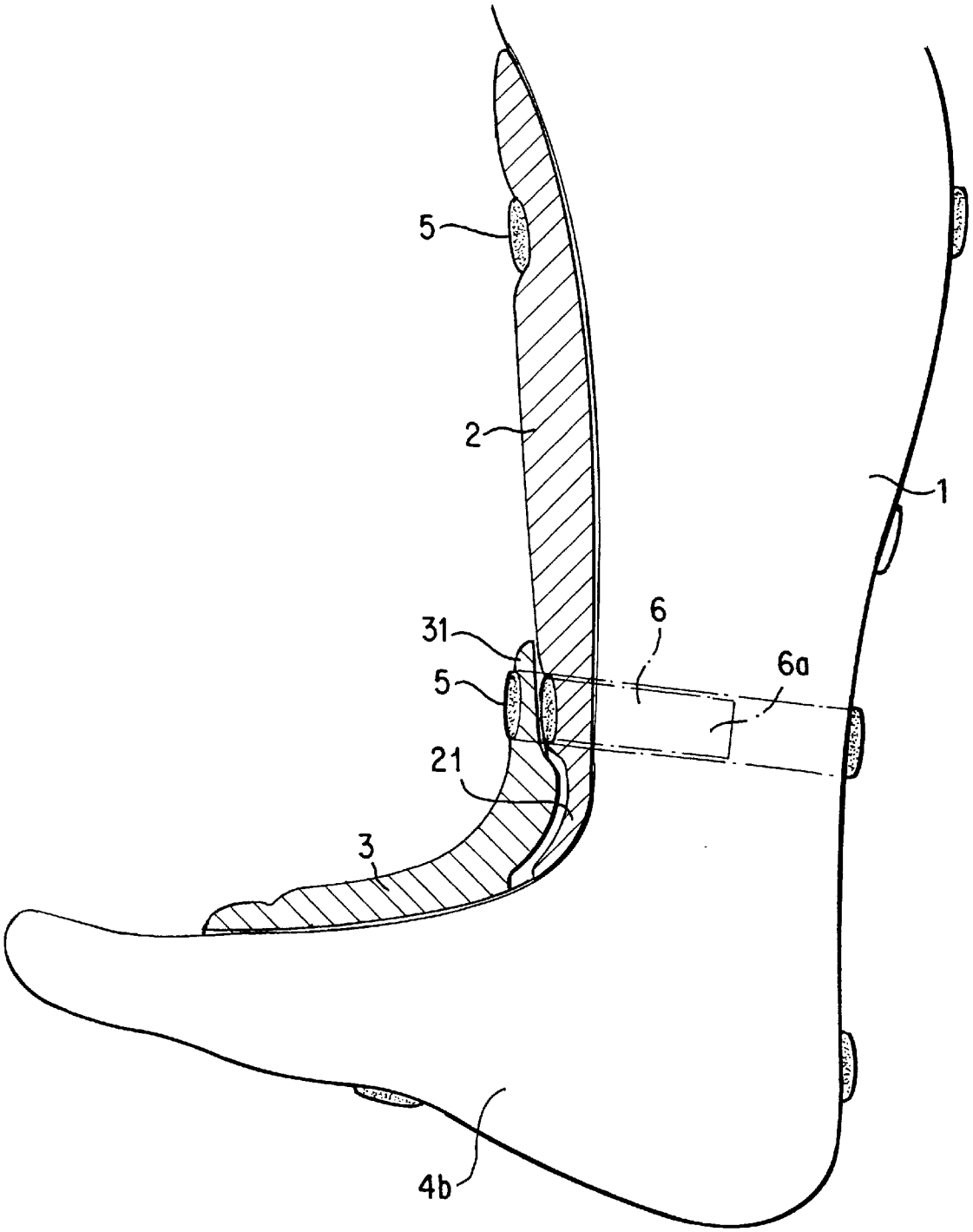

As shown in FIGS. 1 to 3, the protective pad for the foot and shin of an athlete comprises a foot section 3 and a shin guard 2. The shin guard 2 basically designed in a conventional manner is fitted as usual to the lower leg 1 of the athlete by means of retaining straps 5. The shin guard 2 shown only differs from a normal shin guard by a tongue-like extension 21 which connects downwards roughly to the centre (when viewed from the front) of the shin guard below the actual protection zone. The tongue-like extension 21 is designed to be so short that the function as a conventional shin guard (without the associated foot guard 3) is not impaired.

The tongue-like extension 21 is very thin over a substantial portion of its width and is so designed for a soft bending. This contributes quite substantially to it not being an irritant during sports activities. The tongue-like extension 21 contains a rail-like recess 211, which takes up the greater part of its total width and which at its base leaves over only a small part of the wall thickness of the protective pad.

Basically, this tongue-like extension 21 could be avoided if the tongue-like extension 31 of the foot or instep guard 3 were extended accordingly and the rail-like guidance device transposed into the actual protection zone. However, there, the rail-like recess 211 would detract from the protective effect. It would then be necessary either to make the rail-like recess 211 very narrow or to divide it up into two or more spaced narrow single rails or it would be necessary to increase the base wall strength of the shin guard 2 at the point of the rail-like recess 211 by so much that the shin guard 2 would still meet the protection requirements despite the recess. These measures would, however, make the overall construction very thick and very over-dimensioned in inter-action with the tongue 31 of the foot or instep guard 3, for then the tongue 31 would also come to rest on top of the protective zone of the shin guard 2 already made thicker in the shin zone. For these reasons, it is advantageous to provide the tongue-like extension 21 as shown in FIGS. 1 to 3.

The tongue-like extension 31 of the foot or instep guard 3 overlaps the tongue-like extension 21 of the shin guard 2 and its lower central zone. On the inside of the tongue-like extension 31 of the foot guard 3, a slide-like elevation 311 is located which fits with sufficient tolerance to the rail-like recess 211 in the tongue-like extension 21 of the shin guard 2. The slide-like elevation 311 can be formed as a separate component and connected with the tongue-like extension 31. However, it is also possible to form the slide-like elevation 311 integrally with the tongue-like extension. The longitudinal extensions of the rail-like recess 211 and of the essentially equally long slide-like elevation 311, which can also be described as a slide-like fitting, are dimensioned in such a way that with the foot 4 fully extended the slide-like elevation 311 is still guided in the rail (FIG. 2) and that the slide-like elevation 311 does not yet contact the end of the rail 211 with the foot fully raised (FIG. 3).

The lengths of the tongue-like extensions 31, 21 at the foot guard 3 and at the shin guard 2 are dimensioned in such a way that even when the foot is fully extended, at least the rail-like recess 211 is still covered. The length of the tongue-like extension 31 of the foot guard must therefore be at least roughly twice as long as the length of the slide-like elevation 311 on the inside of the tongue-like extension 31. The length of the tongue-like extension 21 on the shin guard is, in contrast, only as long as the length of the rail-like recess 211 or even shorter when this rail-like recess 211 still dips a little into the circumference of the actual shin guard 2.

The slide-like elevation could also rest on the tongue-like extension of the shin guard. In this case, the associated, compatible recess would be provided on the inside of the tongue-like extension on the foot guard. As, however, the tongue-like extension on the shin guard 2 should rather be thin and flexible, while the tongue-like extension on the foot guard should rather be stable, this version is possible, but less preferred.

The tongue on the foot/instep guard 3 is preferably highly arched, preferably approximately as much as the radius of the foot bend when the foot is raised to the maximum (FIG. 3), but possibly also even more. This has the consequence that the tongue-like extension 31 only contacts the shin guard without pressure when the foot is filly raised (FIG. 3), while standing off in every other foot position. Near to the upper end of the tongue-like extension 31, an elastic strap 6 is fitted which runs round the tongue 31. It is also possible to have two single elastic straps symmetrically at both sides of the tongue 31. The two ends 6*a*, 6*b* of the wound strap or the free end in each case of the two single straps are fixed to the shin guard 2. This can be done in accordance with FIG. 5 such that the lower retaining straps 5 of the shin guard 2 are simply thread through eyelets 61 at the free ends 6*a* of the elastic strap 6 or the elastic straps.

The length and tautness of the elastic strap or straps are adjusted so that the tongue 31 on the foot/leg guard is pulled to the shin guard 2 against its arching and is pressed against it in every position at least with low tension.

In an arrangement as in FIGS. 1 to 3, it can be achieved that the contact pressure of the tongue 31 is very uniform in every foot position and so is never so high that the tongue 31 gets caught as a result of high friction. With the foot fully extended 4*a* (FIG. 2), the elastic strap 6 or the elastic straps are extended so much that they exert a correspondingly high force on the tongue 31. This high force is wanted as the tongue 31 has to be pulled almost flat and so highly deformed. With the foot 4*b* raised high (FIG. 3), in contrast, the elastic strap or the elastic straps are shortened as much as possible so that they can only exert a low force which, however, is sufficient, for the tongue 31 contacts the shin guard 2 under its own force with its inherent arching in this position.

In this arrangement, it has been provided that the tongue 31 is always pulled upwards with a certain component by the elastic strap in every foot position 4, 4*a*, except with a maximally raised foot 4*b*, which effectively supports the sliding of the slide-like elevation 311 in the rail 211.

In the embodiment shown in FIG. 4, the special feature comprises the fact that the tongue 32 of the foot guard 3 can slide lengthways in a tunnel-like concavity 22 on the inside of the shin guard 2. In this embodiment, the elastic straps are not required. However, in this arrangement, it must be ensured that the tongue 32 cannot jam in the tunnel 22. The risk of jamming is increased if the shin guard is fitted very tightly and the tunnel volume is thus reduced. The certain function is ensured when the shin guard material is sufficiently rigid, when the cross-section of the tongue 32 is relatively small and when the tongue 32 has sufficiently large play in the tunnel-like concavity 22.

In this embodiment, the volume of the slide 321 which can slide in the tunnel-like concavity 22 is identical to the volume of the tongue-like extension 32 of the foot/instep guard 3. This limits the thickness and extension of the tongue-like extension 32 in comparison to the embodiment from FIGS. 1 to 3 where the extension and thickness and so the padding in the transition from the shin to the foot can be chosen absolutely freely.

In accordance with FIG. 4, it may be appropriate to support the sliding of the tongue 32 in the tunnel-shaped concavity 22 by connecting the end of the tongue 32 with the inside of the shin guard 2 at the end of the concavity 22 by means of an elastic strap (not shown in the drawing). The elastic strap is best connected to the shin guard 2 with Velcro. It must have sufficient expansion movement available to follow the total movement of the foot with a low increase in force.

In sports where sports boots and shin guards are used, such as soccer or hockey, the ankle joint area remains fully unprotected in accordance with the prior art solutions known although this area is at a greater risk of injury and therefore in need of special protection. The reason for this is that every contact between the boot and the shin guard substantially impedes the exercise of the sport.

To solve this problem, it is proposed in accordance with another advantageous embodiment of the invention to design the tongue, which is used anyway and in many cases is already padded and which extends greatly over the edge of the boot with most soccer boots, in the same way as the tongue-like extension of the foot/leg guard described above. Here, both the embodiments described above can be used. In FIG. 5 one embodiment is shown, namely the one where the tongue extension of the boot overlaps the shin guard at the top side.

General practice and the rules of the international association require football stockings to be worn over the shin guards. To take this demand into account, the elastic strap (or the two elastic straps) fixed to the tongue extension can be fixed to the stocking itself by its free ends. This can be done by a Velcro fastening. However, it is also possible to fix the free ends to a Velcro strap which is guided around the calf. These solutions also work without any guidance rail as the tension of the elastic straps is sufficient to centre the tongue extension.

I claim:

1. A protective pad for the foot and shin of a person comprising:

a foot section, a shin guard, and a tongue-like extension included on at least one of the foot section and the shin guard, wherein the tongue-like extension slides over the shin guard, and wherein the shin guard possesses a guidance device which is formed as a rail-like recess.

2. A protective pad in accordance with claim 1, wherein the tongue-like extension possesses a slide-like fitting.

3. A protective pad in accordance with claim 1, wherein inherent arching of the tongue-like extension is less than arching of an upper side of the foot in a most extended position.

4. A protective pad in accordance with claim 1, wherein the protective pad is made from an ethylene/vinyl acetate copolymer.

5. A protective pad in accordance with claim 1, wherein said tongue-like extension is a first tongue-like extension provided on the foot section, and further comprising a second tongue-like extension on the shin guard.

6. A protective pad in accordance with claim 5, wherein the first tongue-like extension is provided on a shoe.

7. A protective pad in accordance with claim 6, wherein said shoe is a sports boot.

8. A protective pad in accordance with claim 5, wherein the first tongue-like extension is designed to be longer than the second tongue-like extension.

9. A protective pad in accordance with claim 1, wherein the foot section is formed as a foot guard.

10. A protective pad in accordance with claim 1, wherein the foot section is formed as a foot and instep guard.

11. A protective pad in accordance with claim 1, wherein the tongue-like extension is formed to be easily flexible.

12. A protective pad in accordance with claim 11, wherein the tongue-like extension is a soft foam protective pad.

13. A protective pad in accordance with claim 1, wherein the tongue-like extension and the shin guard are connected to one another by an elastic strap.

14. A protective pad for the foot and shin of a person comprising:

a foot section, a shin guard, and a tongue-like extension included on at least one of the foot section and the shin guard, wherein the tongue-like extension and the shin guard are connected to one another by an elastic strap.

15. A protective pad in accordance with claim 14, wherein said tongue-like extension is a first tongue-like extension provided on the shin guard, and further comprising a second tongue-like extension on the foot section.

16. A protective pad in accordance with claim 15, wherein the first tongue-like extension is designed to be longer than the second tongue-like extension.

17. A protective pad in accordance with claim 14, wherein said tongue-like extension is a first tongue-like extension provided on the foot section, and further comprising a second tongue-like extension on the shin guard.

18. A protective pad in accordance with claim 17, wherein the first tongue-like extension is provided on a shoe.

19. A protective pad in accordance with claim 18, wherein said shoe is a sports boot.

20. A protective pad in accordance with claim 14, wherein, the foot section is formed as a foot guard.

21. A protective pad in accordance with claim 14, wherein the foot section is formed as a foot and instep guard.

22. A protective pad in accordance with claim 14, wherein the tongue-like extension is formed to be easily flexible.

23. A protective pad in accordance with claim 22, wherein the tongue-like extension is a soft foam protective pad.

24. A protective pad in accordance with claim 14, wherein the tongue-like extension slides under the shin guard.

25. A protective pad in accordance with claim 24, wherein the shin guard possesses a tunnel-like concavity.

26. A protective pad in accordance with claim 14, wherein inherent arching of the tongue-like extension is less than arching of an upper side of the foot in a most extended position.

27. A protective pad in accordance with claim 14, wherein the, protective pad is made from an ethylene/vinyl acetate copolymer.

* * * * *